United States Patent [19]

Wyse

[11] Patent Number: 4,484,663

[45] Date of Patent: Nov. 27, 1984

[54] PORTABLE PERSONNEL PLATFORM LIFT

[75] Inventor: Mark R. Wyse, Archbold, Ohio

[73] Assignee: Bil-Jax, Inc.

[21] Appl. No.: 233,925

[22] Filed: Feb. 12, 1981

[51] Int. Cl.[3] ..... B66B 9/20

[52] U.S. Cl. ..... 187/9 E; 187/95; 308/3 B

[58] Field of Search ..... 187/9 E, 9 R, 95; 182/148, 62.5; 308/3 B, 3 C, 3 R; 414/628-631; 212/183, 184, 182, 187, 199

[56] References Cited

U.S. PATENT DOCUMENTS

| | | | |
|---|---|---|---|
| 2,743,966 | 5/1956 | McKernan | 187/95 |
| 2,936,047 | 5/1960 | Quayle | 187/9 E |
| 3,768,595 | 10/1973 | Kelley, Jr. | 187/95 |
| 4,015,686 | 4/1977 | Bushnell, Jr. | 187/9 E |

FOREIGN PATENT DOCUMENTS

| | | | |
|---|---|---|---|
| 2016410 | 9/1979 | United Kingdom | 187/9 E |

*Primary Examiner*—Kenneth W. Noland
*Attorney, Agent, or Firm*—Allen D. Gutchess, Jr.

[57] ABSTRACT

A portable personnel platform lift is provided, having a base mast or section and a plurality of extendible, nesting masts or sections with a personnel platform on the upper section. The extendible sections are constructed with nesting side rails which are identical in size and shape. This reduces the inventory of materials required and also facilitates fabrication of the components of the lift. The base and extendible sections have adjustable greaseless guide blocks to eliminate periodic lubrication and dirty rails. The plaform and the extendible sections also are designed to enable a worker to enter the platform from the floor without a ladder when the platform is in the lowest position.

12 Claims, 5 Drawing Figures

PORTABLE PERSONNEL PLATFORM LIFT

This invention relates to a portable personnel platform lift.

Hydraulic lifts for portable personnel platforms are known in the art. However, the platform lift in accordance with the invention is of an improved design and has a number of advantages over those heretofore known. The new platform lift has a base with a base mast or section extending upwardly therefrom and a plurality of extendible, nesting masts or sections, the uppermost one of which has a personnel platform thereon. The extendible sections can be raised and lowered through a hydraulic pump driven by a motor which can be operated by a battery. The extendible sections of the lift are constructed with nesting side rails, all of which are identical in both size and shape. These are of Z-shaped configuration, each having an outwardly-extending flange along one edge engagable with a lower section and an inwardly-extending flange along the other edge engagable with an upper section. Heretofore, platform lifts with extendible sections required side rails of different sizes, if not different shapes. With the use of identical side rails, the required inventory of materials is greatly reduced. Further, fabrication of the components of the lift is also simplified.

The base section and the extendible sections also have adjustable greaseless guide blocks which engage the flanges of the side rails. These eliminate the requirement for periodic lubrication and also eliminate the grease along the rails which is conducive to soiling and also collects dirt and dust. The lifting mechanism for the extendible sections also can employ non-conductive sheaves or pulleys so that the platform is electrically isolated from the ground. This constitutes a substantial safety factor when the worker on the platform is involved in electrical construction or repair.

The platform and the extendible sections also are designed to enable the worker to enter the platform from the floor without the need for a ladder when the platform and sections are in the lowest positions.

It is, therefore, a principal object of the invention to provide a portable personnel platform lift having the features and advantages discussed above.

Many other objects and advantages of the invention will be apparent from the following detailed description of a preferred embodiment thereof, reference being made to the accompanying drawings, in which.

Figure 1:
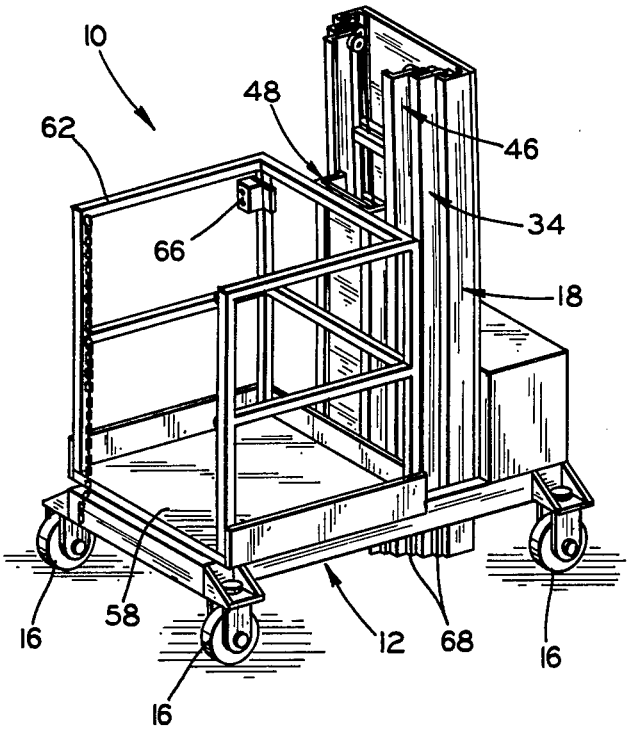
FIG. 1 is a somewhat schematic view in perspective of a portable personnel platform lift embodying the invention, shown in the lowest position.
Figure 2:
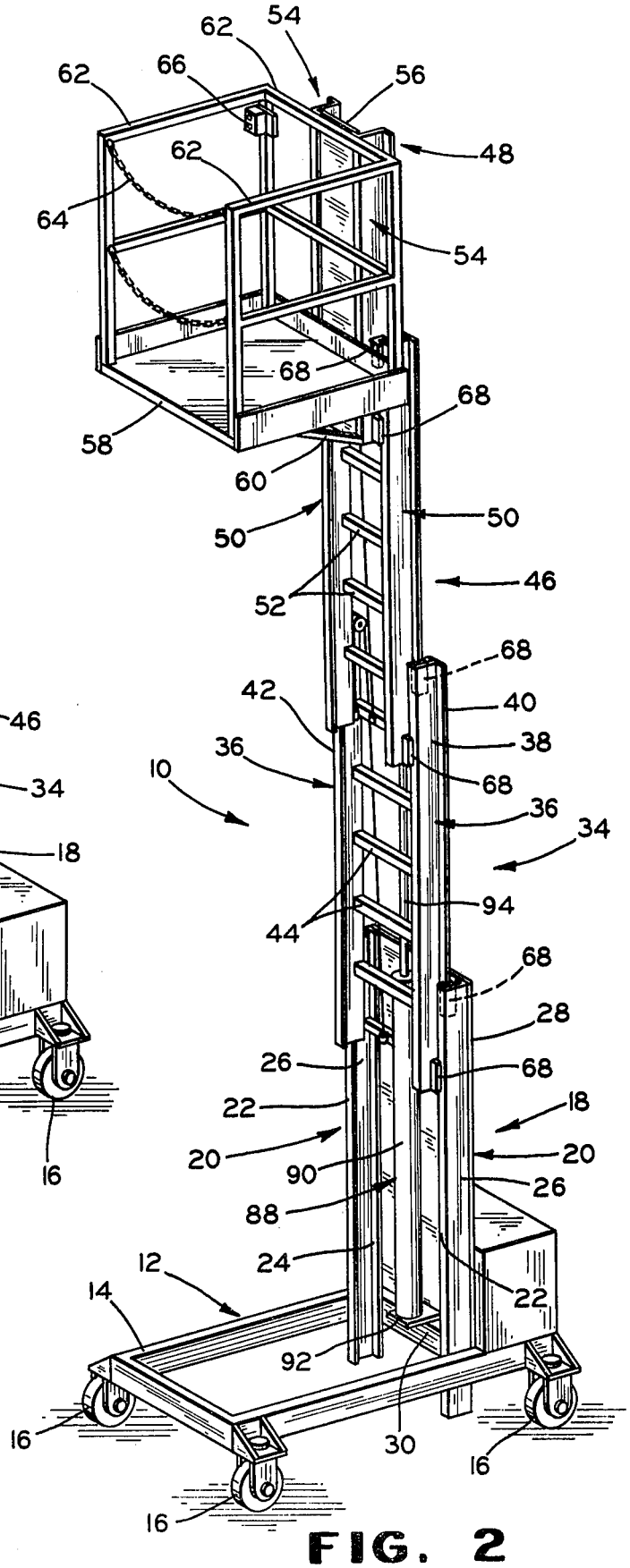
FIG. 2 is a somewhat schematic view in perspective of the personnel platform lift, shown in the highest position.
Figure 3:
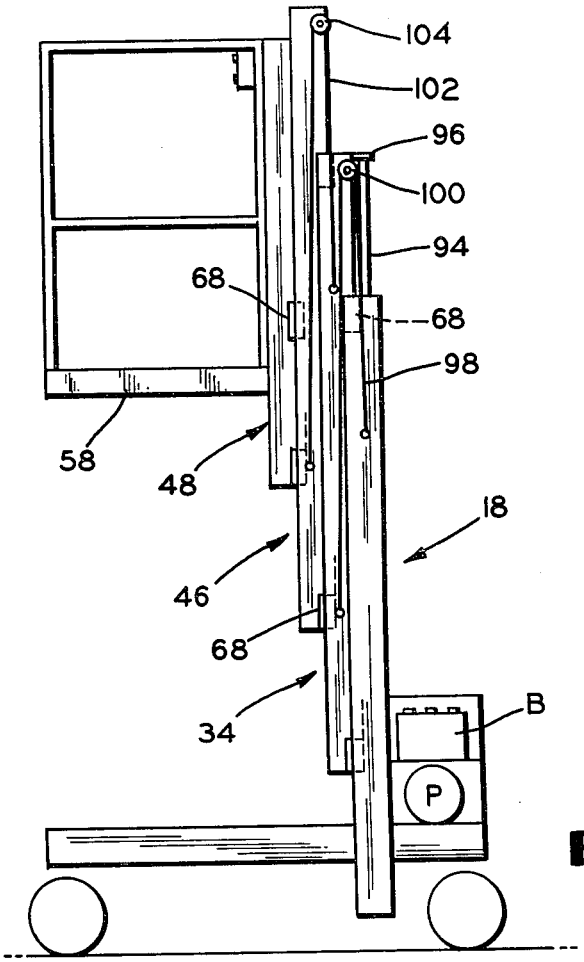
FIG. 3 is a diagrammatic side view in elevation showing the platform lift with means for raising and lowering extendible masts or sections of the lift.

Referring to the drawings, and particularly to FIGS. 1–3, a portable personnel platform lift embodying the invention is indicated at 10. Certain conventional components, such as outriggers and some structural members are deleted, and certain other components are shown in a somewhat schematic form.

The platform lift includes a base 12 having a rectangular frame 14 supported on casters 16. A base mast or section 18 extends upwardly from the base in a fixed position and includes side channels or rails 20 which extend somewhat below the base frame 14. The side rails 20 include forward inwardly-extending flanges 22 and rearward inwardly-extending flanges 24 spaced apart by a web 26. The side rails are maintained in spaced relationship by an end plate 28 and other cross struts 30. Reinforcing tubes 32 (FIG. 4) also extend upwardly along a substantial portion of the side rails 20.

A first extendible, nesting mast or section 34 is transversely supported by the base section 18 and can be moved up and down relative thereto. The extendible section 34 includes side rails 36 which are of generally Z-shaped configuration in transverse cross section. Each of the rails 36 includes a web 38 having an outwardly-extending, transverse flange 40 along one edge and extending the length thereof and an inwardly-extending, transverse flange 42 along the other edge of the web and extending the length thereof. The flanges 40 extend toward the webs 26 of the rails 20 on the inside of the forward inwardly-extending flanges 22 of the rails 20. The side rails 36 are held in a fixed, spaced relationship by suitable transverse frame members or bars 44.

Additional extendible, nesting masts or sections 46 and 48 can be used to increase the height of the platform lift 10. In practice, two to four extendible masts or sections are used, with three being shown in this instance. The second extendible section 46 has side rails 50 of Z-shaped configuration in transverse cross section, being identical in size and shape to the side rails 36 of the extendible section 34. However, the side rails 50 are closer together than the rails 36, being held apart in spaced relationship by suitable frame members or bars 52. The outwardly-extending transverse flanges 40 of the rails 50 extend toward the webs 38 of the rails 36 inside the flanges 42 of the rails 36. The extendible section 46 is supported transversely by the extendible section 34 but can move up and down relative thereto.

The third, extendible section 48, being the uppermost one in this instance, also has side rails 54 which are of Z-shaped configuration in transvere cross section, being identical in size and shape to the side rails 50 of the extendible section 46 and to the side rails 36 of the extendible section 34. The rails 54 are closer together than the rails 50 and are held in spaced relationship by a suitable cross frame member or panel 56. The outwardly-extending flanges 40 of the side rails 54 extend toward the webs 38 of the rails 50 and are located inside the inwardly-extending flanges 42 of the rails 50. The extendible section 48 is transversely supported by the extendible section 46 but can move up and down relative thereto.

A platform 58 is mounted on the front of the extendible section 48 by suitable frame members 60 and has suitable sides indicated at 62 along with chains 64 when the platform is used by a worker. The worker can raise and lower the extendible sections 34, 46 and 48 by means of a control box 66. If desired, the sides 62 and the chains 64 can be removed, along with the control box 66, to raise and lower loads on the platform 58, the control box 66 then being operated from the ground by the worker.

Figure 4:
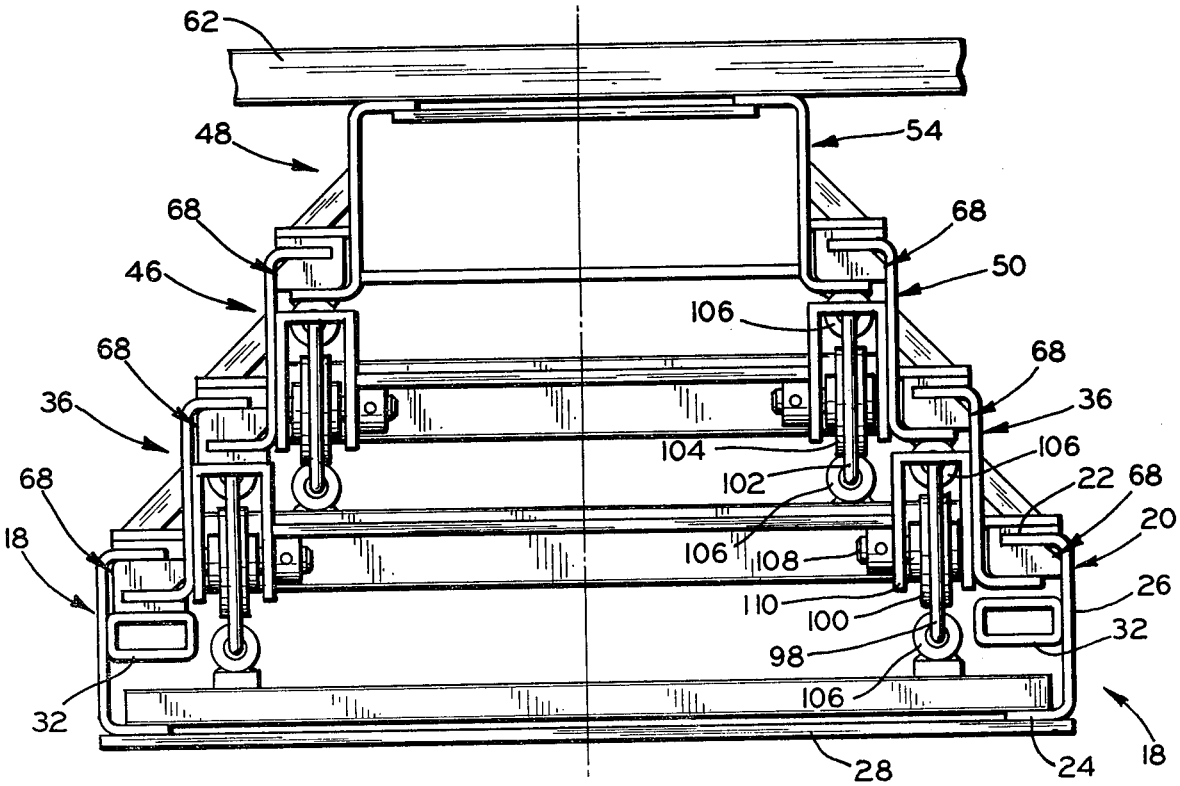
FIG. 4 is an enlarged, fragmentary top view of the platform lift.

Means are provided which are engagable between the adjacent masts or sections so that the upper section can be transversely supported by the adjacent lower one and guided by the engagable means for lineal, upright movement relative to the lower section. Preferably, the engagable means constitute greaseless guide shoes or blocks 68 which are shown in their respective locations in FIGS. 2 and 4, and in detail in FIG. 5. FIG. 4 shows the upper guide blocks of the sections on the left and the lower ones on the right. The guide blocks 68 preferably are of a slippery material which requires no lubrication or grease. Such material can be certain nylons, Teflon, Delrin, or graphite-impregnated phenolic resins, or even certain sintered metals. With guide blocks of this nature, no grease is necessary between the adjacent side rails, which eliminates periodic lubrication. The grease is easy to come in contact with and cause soiling of worker's clothing, objects being handled, etc. The grease also collects dirt and dust which can reduce its lubricating effectiveness and requires occasional cleaning.

Figure 5:
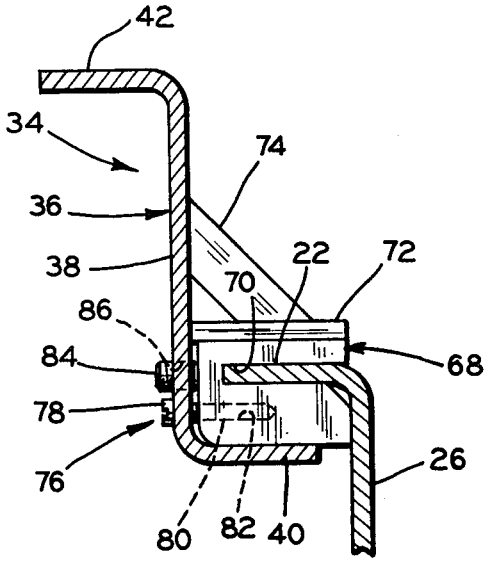
FIG. 5 is a detailed view in transverse cross section showing a guide block of the platform lift.

As shown in FIG. 5, the guide block 68 is the one located at the lower end of the first extendible nesting section 34 and is specifically at the lower end of the left hand side rail 36 of the section 34, as viewed in FIG. 2. The guide block is of generally rectangular configuration and has a length of about six inches. It has a groove 70 throughout its length which receives the inwardly-extending forward flange of the base section 18, in this instance. The guide block is backed up by the outwardly-extending flange 40 of the side rail 36 of the extendible section 34 and by a spaced supporting flange 72 extending outwardly from the web 38 of the side rail 36 in parallel relationship to the flange 40, being backed up by gussets 74. The flanges 40 and 72 provide structural strength for the guide blocks 68 and virtually eliminate the possibility of structural failure of the blocks.

The guide blocks are attached to the side rails 36 by threaded fasteners 76 having exposed heads 78 and threaded shanks 80 received in threaded bores 82 in the blocks 68. Two of the threaded fasteners 76 are employed in spaced relationship with a setscrew 84 located therebetween and threadedly received in a threaded hole 86 in the web 38 of the rail 36. The guide block 68 can be adjusted in and out relative to the guide rail to which it is attached by the threaded fasteners 76 and the threaded setscrew 84. To move the guide block out, the screws 76 are backed off and the setscrew 84 is turned inwardly. To move the guide block 68 back toward the side rail, the setscrew 84 is turned outwardly and the threaded fasteners 76 are turned inwardly. The guide blocks 68 for the rails 20 are each mounted by only one of the fasteners 76 and employ two of the setscrews 84.

Two of the guide blocks 68 provide engagement between each of the side rails of the extendible sections 34, 46 and 48 and the section immediately therebelow. As shown in FIG. 2, the guide blocks 68 are located adjacent upper ends of the inwardly-extending flanges 22 of the side rails 20 of the base section 18 and engage the outwardly-extending flanges 40 of the first extendible section 36. The guide blocks 68 are also located at the lower ends of the side rails 36 of the extendible section 34 adjacent the outwardly-extending flanges 40 thereof and engage the forward inwardly-extending flanges 22 of the side rails 20 of the base section 18.

Similarly, the guide blocks are located at the upper ends of the rails 36 of the extendible section 34 adjacent the inwardly-extending flanges 42 thereof and engage the outwardly-extending flanges 40 of the extendible section 46. The guide blocks are also located at the lower ends of the extendible sections 46 and 48 adjacent the outwardly-extending flanges 40 thereof and engage the inwardly-extending flanges 42 of the extendible sections 36 and 46. The upper section 48 also has additional guide blocks about fifteen inches above its lower ones for additional stability. Therefore, there are always four guide blocks engaging the adjacent sections and there are always two guide blocks engaging corresponding adjacent side rails of the adjacent sections.

The extendible sections can be raised and lowered by many suitable means. As shown, a hydraulic ram 88 (FIG. 2) has a cylinder 90 mounted on a supporting flange 92 of the base section 18. The ram also has an upwardly-extending piston rod 94 connected to a rearwardly-extending flange 96 at the upper end of the first extendible section 34 (see FIG. 3). Fluid under pressure can be supplied to the cylinder 90 by a gear-type pump P driven by an electric motor (not shown) which is powered by a suitable battery B. A suitable reservoir can also be employed.

A cable 98 is affixed to an intermediate portion of the base section 18 and to a lower end portion of the second extendible section 46. The cable 98 extends over a sheave or pulley 100 located at an upper portion of the first extendible section 36. A second cable 102 is affixed to an intermediate portion of the first extendible section 36 and to a lower portion of the third extendible section 48. This cable extends over a sheave or pulley 104 located at an upper portion of the second extendible section 46. When the first extendible section 36 is raised by the fluid-operated ram 88, it raises the second extendible section 46 by a like amount through the cable 98. The raising of the second extendible section 46 also raises the third extendible section 48 by a like amount through the cable 102. The pulleys are mounted on axles 108 which are suitably carried by brackets 110 affixed to upper end portions of the extendible sections 36 and 46.

Referring to FIG. 4, the pulleys or sheaves 100 and 104 can be of identical construction and preferably are made of a nonconducting material along with cable anchors or eyes 106 to which the ends of the cables 98 and 102 are connected to the respective extendible sections. In this manner, the sections 36, 46 and 48 are electrically isolated from one another so that the platform 58 can be electrically isolated from the ground. This is an important factor when a worker is undertaking electrical or repair work.

With all of the side rails 36 of the extendible sections 34, 46, and 48 being identical in both size and shape, inventory costs are substantially reduced. It is also easier to fabricate the sections with the only differences being in the length of the frame members that space and separate the side rails.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A portable personnel platform lift comprising a base, a base section extending upwardly from said base, said base section having side rails with inwardly-extending flanges, a first extendible, nesting section having two side rails, each of said side rails of said first section having an outwardly-extending flange, means engagable with the outwardly-extending flanges of said first extendible section and the inwardly-extending flanges of said base section for guiding said first extendible section in a linear path, each of said side rails of said first section also having an inwardly-extending flange, a second extendible, nesting section havng two side rails which are identical in size and shape to said side rails of said first extendible section, each of said side rails of said second extendible section also having an outwardly-extending flange, means engagable with said inwardly-extending flanges of the side rails of said first extendible section and said outwardly-extending flanges of said second extendible section for guiding said second extendible section in a linear path, said engagable means comprising greaseless blocks of slippery material, and means for raising and lowering said first and said second extendible sections.

2. A lift according to claim 1 characterized by said greaseless blocks being adjustable toward and away from one of the side rails of either the first or second extendable sections.

3. A portable personnel platform lift comprising a base, a base section extending upwardly from said base, said base section having opposite inwardly-extending flanges, a first extendible, nesting section having two side rails of generally Z-shaped configuration in transverse cross section, means engagable with said side rails and said inwardly-extending flanges of said base section for guiding said first extendible section in a linear path, a second extendible, nesting section having two side rails of generally Z-shaped configuration in transverse cross section and being identical in size to said two side rails of said first extendible section, and means engagable with the side rails of said second extendible section and said first extendible section for guiding said second extendible section in a linear path, whereby said first extendible section can move vertically relative to said base section and said second extendible section can move vertically relative to said first extendible section, said engagable means comprising greaseless blocks of slippery material.

4. A lift according to claim 3 characterized by said greaseless blocks being adjustable toward and away from one of the side rails of either the first or second extendable sections.

5. A platform lift comprising a base, a base section extending upwardly from said base, said base section having transversely-extending flanges, a first extendible, nesting section having two side rails, said side rails having first transversely-extending flanges extending toward said transversely-extending flanges of said base section, first greaseless guide blocks attached to upper portions of said base section and engagable with said first transversely-extending flanges of said first extendible section, second greaseless guide blocks attached to lower portions of said side rails of said first extendible section and engagable with said transversely-extending flanges of said base section, said side rails of said first extendible section having second transversely-extending flanges spaced from said first transversely-extending flanges, a second extendible, nesting section having two side rails with transversely-extending flanges, third greaseless guide blocks attached to upper portions of said first extendible sections and engagable with said transversely-extending flanges of said second extendible section, and fourth greaseless guide blocks attached to lower portions of said second extendible section and engagable with said second transversely-extending flanges of said first extendible section.

6. A lift according to claim 5 characterized by said guide blocks being adjustable in and out relative to the sections to which they are attached.

7. A lift according to claim 5 characterized by said side rails of said second extendible, nesting section having second transversely-extending flanges, third extendible, nesting section having two side rails with transversely-extending flanges, and fifth greaseless guide blocks attached to said third extendible section and engagable with said second transversely-extending flanges of said second extendible section.

8. A lift according to claim 7 characterized by sixth greaseless guide blocks attached to said third extendible section spaced from said fifth greaseless guide blocks, and engagable with said second transversely-extending flanges of said second extendible section.

9. A lift according to claim 8 characterized by there being a platform attached to edges of said side rails of said third extendable section opposite said transversely-extending flanges of said third extendable section and extending outwardly therefrom in a direction away from said second extendible section and said first extendible section.

10. A lift according to claim 5 characterized by said first transversely-extending flanges of said side rails of said first extendible section extending outwardly from said side rails of said first extendible section and said second transversely-extending flanges of said side rails of said first extendible section extending inwardly from said side rails of said first extendible section in a direction opposite said first transversely-extending flanges thereof.

11. A portable personnel platform lift comprising a base, a base section extending upwardly from said base, said base section having side rails with inwardly-extending flanges, a first extendible, nesting section having two side rails of generally Z-shaped configuration in transverse cross section, each of said side rails of said first section having an outwardly-extending flange, means engageable with the outwardly-extending flanges of said first extendible section and the inwardly-extending flanges of said base section for guiding said first extendible section in a linear path, each of said side rails of said first extendable section also having an inwardly-extending flange, said outwardly-extending flange and said inwardly-extending flange of each of said side rails of said first extendable section being connected by a straight web which is perpendicular to each of said flanges of each of said side rails of said first extendable section, a second extendible, nesting section having two side rails of generally Z-shaped configuration in transverse cross section which are identical in size and shape to said side rails of said first extendible section, each of said side rails of said second extendible sections also having an outwardly-extending flange, means engagable with said inwardly-extending flanges of the side rails of said first extendible section and said outwardly-extending flanges of said second extendible section for guiding said second extendible section in a linear path, and means for raising and lowering said first and said second extendible sections.

12. A portable personnel platform lift comprising a base, a base section extending upwardly from said base, said base section having opposite inwardly-extending flanges, a first extendible, nesting section having two side rails of generally Z-shaped configuration in transverse cross section, each of said side rails having oppositely-extending flanges connected by a straight, planar web, means engagable with said side rails and said inwardly-extending flanges of said base section for guiding said first extendible section in a linear path, a second extendible, nesting section having two side rails of generally Z-shaped configuration in transverse cross section and being identical in size to said two side rails of said first extendible section, and means engagable with the side rails of said second extendible section and said first extendible section for guiding said second extendible section in a linear path, whereby said first extendible section can move vertically relative to said base section and said second extendible section can move vertically relative to said first extendible section.

* * * * *